US006612877B2

(12) United States Patent
Hyland

(10) Patent No.: US 6,612,877 B2
(45) Date of Patent: Sep. 2, 2003

(54) RJ MODULAR CONNECTOR HAVING PRINTED CIRCUIT BOARD HAVING CONDUCTIVE TRACE TO BALANCE ELECTRICAL COUPLINGS BETWEEN TERMINALS

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/037,706

(22) Filed: Dec. 29, 2001

(65) Prior Publication Data

US 2002/0177367 A1 Nov. 28, 2002

Related U.S. Application Data

(63) Continuation-in-part of application No. 09/863,942, filed on May 22, 2001, now Pat. No. 6,413,121.

(51) Int. Cl.[7] ..... H01R 24/00

(52) U.S. Cl. ..... 439/676; 439/83; 439/607; 439/620; 439/941

(58) Field of Search ..... 439/676, 941, 439/620, 607, 83

(56) References Cited

U.S. PATENT DOCUMENTS 6,196,880 B1 * 3/2001 Goodrich et al. ..... 439/676
6,283,795 B1 * 9/2001 Chen ..... 439/676
6,350,158 B1 * 2/2002 Arnett et al. ..... 439/676
6,409,547 B1 * 6/2002 Reede ..... 439/676
6,413,121 B1 * 7/2002 Hyland ..... 439/676

* cited by examiner

*Primary Examiner*—P. Austin Bradley
*Assistant Examiner*—Truc Nguyen
(74) *Attorney, Agent, or Firm*—Wei Te Chung

(57) ABSTRACT

A RJ modular connector (1) includes a housing (10) defining a plug receiving section, and a terminal core receiving section. A terminal core is (20) received in the terminal core receiving section and includes a number of terminals. A first and a second substrates (31, 41) are provided having a first and a second conductive traces thereon, respectively. The terminals are securely mounted onto the substrates. An electrical connection is established between a first and a second terminals and the first and second conductive traces, respectively, and portions of the conductive traces are arranged to create a first and a second electrical couplings between the first and a third terminals and the second and a fourth terminals. The third and the fourth terminals are arranged between the first and the second terminals and are located close to each other but far from the first and the second terminals, respectively.

1 Claim, 10 Drawing Sheets

RJ MODULAR CONNECTOR HAVING PRINTED CIRCUIT BOARD HAVING CONDUCTIVE TRACE TO BALANCE ELECTRICAL COUPLINGS BETWEEN TERMINALS

This is a continuation-in-part of Ser. No. 09/863,942 filed on May 22, 2001 now U.S. Pat. No. 6,413,121.

BACKGROUND OF THE INVENTION

1. Field of the Invention

The present invention relates to a RJ modular connector, and more particularly to a RJ modular connector having a substrate provided therein to balance electrical couplings between terminals.

2. Description of the Related Art

RJ modular connector has been widely used in telecommunication system since it was firstly created. A so-called RJ45 modular connector has been widely used in the network system.

The RJ45 modular connector includes a total of eight terminals. Resulting from miniaturization of the computer, all corresponding components, including connectors, have to be reduced for their dimension and size. One of the negative consequences or problem created from miniaturization is electrical coupling between terminals. When the RJ connector is used in low speed signal transmission, the couplings between adjacent terminals can be ignored in light of its effect. However, when the RJ connector is used for high speed signal transmission, the couplings between adjacent terminals create a great problem. Unless the electrical coupling can be effectively controlled within an accepted level, it is unlikely that the RJ 45 modular connector can be used in the high-speed signal transmission.

One of the approaches is to select a pair of terminals as a differential pair. In the differential pair, two terminals transmit the same signal but with inverted phase. By this arrangement, the couplings coupled thereto can be finally subtracted in a data processing unit.

As known to one of ordinary skilled in the pertinent art that there are at least eight different patterns in selecting terminals as differential pair, i.e. T568A, T568B, USOC 4-pair, USOC 1-, 2- or 3-pair, 10BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries with it a coupling issue to be addressed.

Among those patterns, T568A and T568B are widely used and in T568A, terminals 1, 2 configure $3^{rd}$ pair, terminals 3, 6 configure $2^{nd}$ pair, terminals 4, 5 configure $1^{st}$ pair while terminals 7, 8 configure $4^{th}$ pair. In T568B, terminals 1, 2 configure $2^{nd}$ pair, terminals 3, 6 configure $3^{rd}$ pair, terminals 4, 5 configure $1^{st}$ pair, while terminals 7, 8 configure $4^{th}$ pair.

Since those eight terminals are equally spaced, electrical couplings between terminals will surely create some problems, i.e. coupling or cross-talk. For example, if we take terminal 3 into consideration, terminal 3 will naturally pick up energy coupled from terminals 2 and 4 which are close to terminal 3. On the other hand, terminal 6, which carries signal having inverted phase of the signal carried by terminal 3, will also pick up energy coupled from terminals 5 and 7. However, energy coupled into terminals 3, 6 from terminals 2 and 7 can not be suitably eliminated because terminals 3, 6 is unlikely to establish couplings between terminal 1 and terminal 8 to balance the couplings between terminals 2, 3 and 6, 7. Accordingly, signals transmitted by terminals 3, 6 carry noises generated by their adjacent terminals 2, 7. In addition, terminals 3 and 6 will also carry noises coupled thereto from terminals 4, 5 and which couplings should be also carefully taken care of in order to avoid certain noises.

In order to decrease the effects of electrical coupling between the ($3^{rd}$, $4^{th}$) and ($3^{rd}$, $2^{nd}$) terminals, and ($6^{th}$, $5^{th}$) and ($6^{th}$, $7^{th}$) terminals, many approaches have been provided, such as creating electrical couplings between $3^{rd}$ and $1^{st}$ terminals and $3^{rd}$ and $5^{th}$ terminals to balance the electrical coupling between the $3^{rd}$ and $2^{nd}$ terminals and $3^{rd}$ and $4^{th}$ terminals, and creating electrical coupling between $6^{th}$ and $8^{th}$ terminals and $6^{th}$ and $4^{th}$ terminals to balance the electrical couplings between the $6^{th}$ and $7^{th}$ terminals and $6^{th}$ and $5^{th}$ terminals.

However, as mentioned above, those eight terminals are arranged in a common plane, it is impossible to create those balancing electrical couplings, i.e. ($1^{st}$, $3^{rd}$), ($3^{rd}$, $5^{th}$), and ($4^{th}$, $6^{th}$), ($6^{th}$, $8^{th}$) terminals when all terminals are located in the same level, it is unlikely to create any electrical channels therebetween to create those electrical couplings accordingly.

The Siemon Company, a US company, discloses a solution posted on the Internet, http://www.siemon.com/white_papers/99-08-30-through-hole.asp. A hard copy thereof is herein attached for reference.

As clearly shown in FIG. 4 of that reference, $6^{th}$ and $2^{nd}$ terminals are arranged in the first layer, while $8^{th}$, $5^{th}$, $4^{th}$, and $1^{st}$ terminals are arranged in the second layer, and $7^{th}$ and $3^{rd}$ terminals are arranged in the third layer.

The $6^{th}$ terminal in the first layer has a rectangular loop having its longitudinal sides aligned with terminals $4^{th}$ and $8^{th}$ located in the second layer, while terminal 3 in the third layer also has a rectangular loop having its longitudinal sides aligned with terminals $5^{th}$ and $1^{st}$ located in the second layer.

In addition, the right longitudinal loop side of the terminal $6^{th}$ further includes a square corresponding to a square formed in terminal $4^{th}$. The left longitudinal loop side of the terminal 3 includes also a square with respect to the square formed on terminal $8^{th}$.

Arrangements suggested by Siemon are to increase the couplings between ($1^{st}$, $3^{rd}$), ($3^{rd}$, $5^{th}$), and ($4^{th}$, $6^{th}$), ($6^{th}$, $8^{th}$) terminals thereby helping to balance electrical couplings of the terminals.

However, those eight or four set sets of terminals are arranged in three different layers, and each set of terminals are separately divided by an insulative sheet material. This will no doubt increase the complexity of the connector.

In addition, there are five different shapes and configurations among those eight terminals. Each terminal has its own shape which is different from each other, especially the $3^{rd}$ and $6^{th}$ terminals, each including the rectangular loop portion which overlaps corresponding terminals to create desired electrical couplings. Each loop further forms the square to increase the electrical couplings with corresponding terminals having the square. The electrical couplings created can help to meet higher system requirement. The eight different configuration of the terminals will surely increase the difficulty and complexity in production.

There are some other approaches, including routing terminal tails of those $3^{rd}$, $6^{th}$ and $4^{th}$, $5^{th}$ terminals to alter their position and affect couplings between $3^{rd}$, $2^{nd}$ and $3^{rd}$, $4^{th}$;

and $6^{th}$, $5^{th}$, and $6^{th}$, $7^{th}$ terminals. However routing terminal tails will inevitably increase the manufacturing cost.

U.S. Pat. No. 6,120,329, issued to Steinman on Sep. 19, 2000, discloses another approach to solve the above-addressed problem. Again, terminals are configured with different shapes and dimensions making the production complex.

U.S. Pat. No. 5,069,641 issued to Sakamoto et al. discloses a suggestion of using printed circuit board in the RJ modular housing, however, it addresses different issues.

SUMMARY OF THE INVENTION

It is an object of this invention to provide an RJ modular connector, and more particularly to an RJ modular connector having a substrate with conductive traces provided therein to balance electrical couplings between terminals.

It is still an object of this invention to provide a RJ modular connector which can be easily manufactured.

In order to achieve the objective set forth, an RJ modular connector in accordance with the present invention comprises a housing defining a plug receiving section, and a terminal core receiving section. A terminal core is received in the terminal core receiving section and includes a plurality of terminals. A first and a second substrates are provided having first and second conductive traces thereon, respectively. The terminals are securely mounted onto the substrates. A first and a second electrical connections are established between a first and a second terminals and the first and second conductive traces, and a portion of each conductive trace is arranged to create a first and a second electrical couplings between the first and second terminals and a third and a fourth terminals, respectively. The third and the fourth terminals are arranged between the first and the second terminals and configure a differential pair located far from the first and the second terminals.

Other objects and further features of the present invention will be apparent from the following detailed description when read in conjunction with the accompanying drawings.

DETAILED DESCRIPTION OF THE INVENTION

Figure 1A:
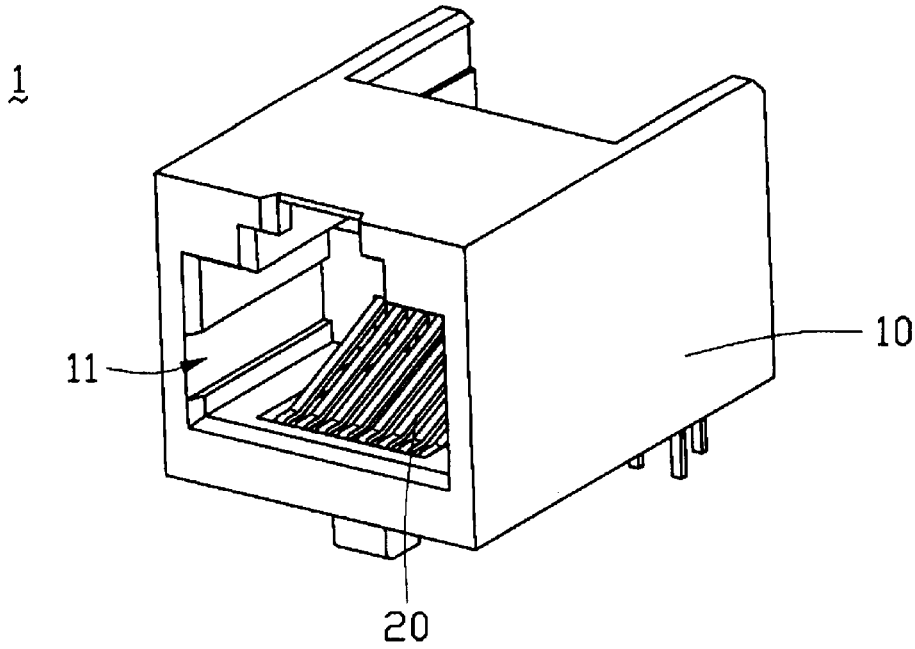
FIG. 1A is a perspective view of a RJ modular connector in accordance with the present invention.
Figure 1B:
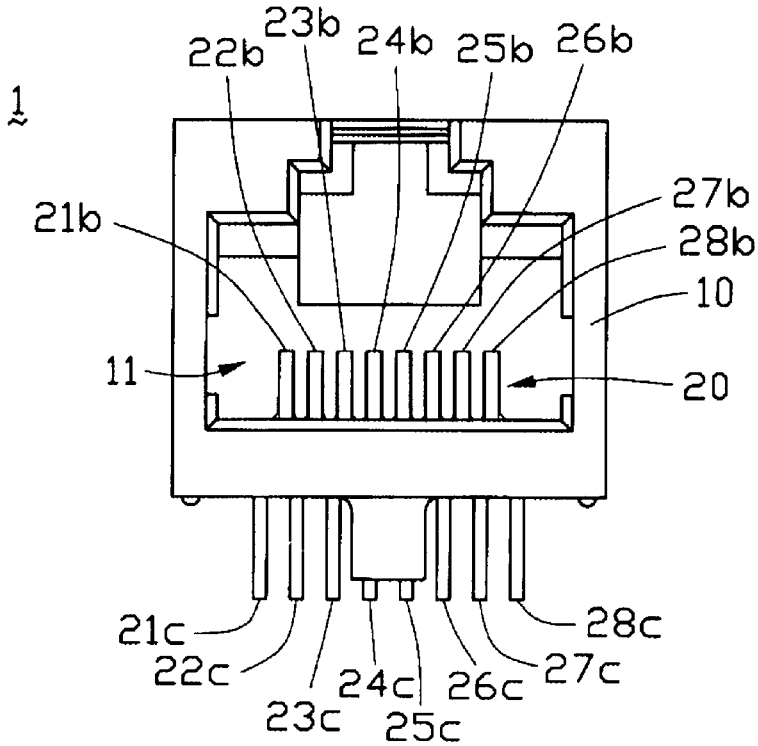
FIG. 1B is a front view of FIG. 1A.
Figure 1C:
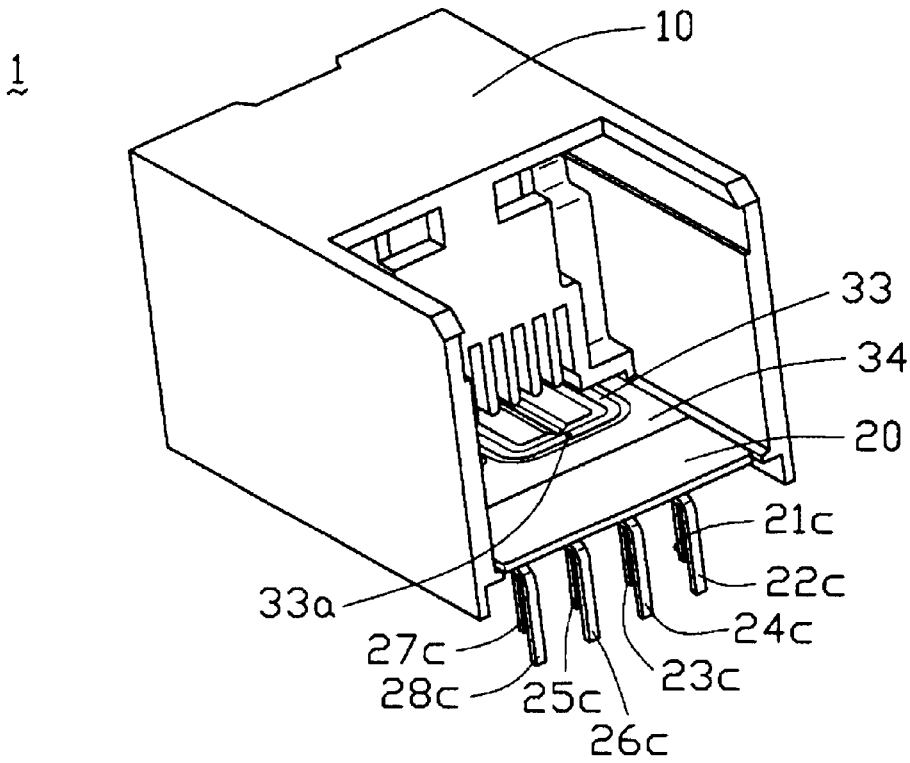
FIG. 1C is similar to FIG. 1A except viewed from a reverse direction.
Figure 1D:
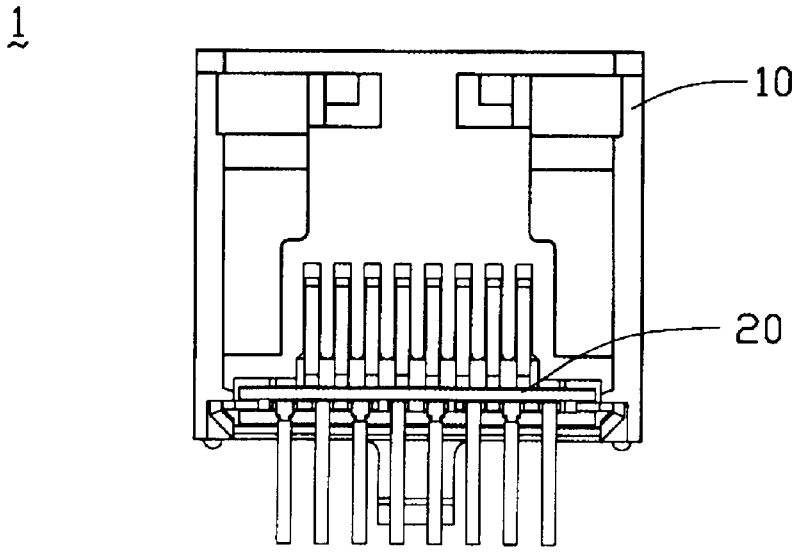
FIG. 1D is a front view of FIG. 1C.
Figure 1E:
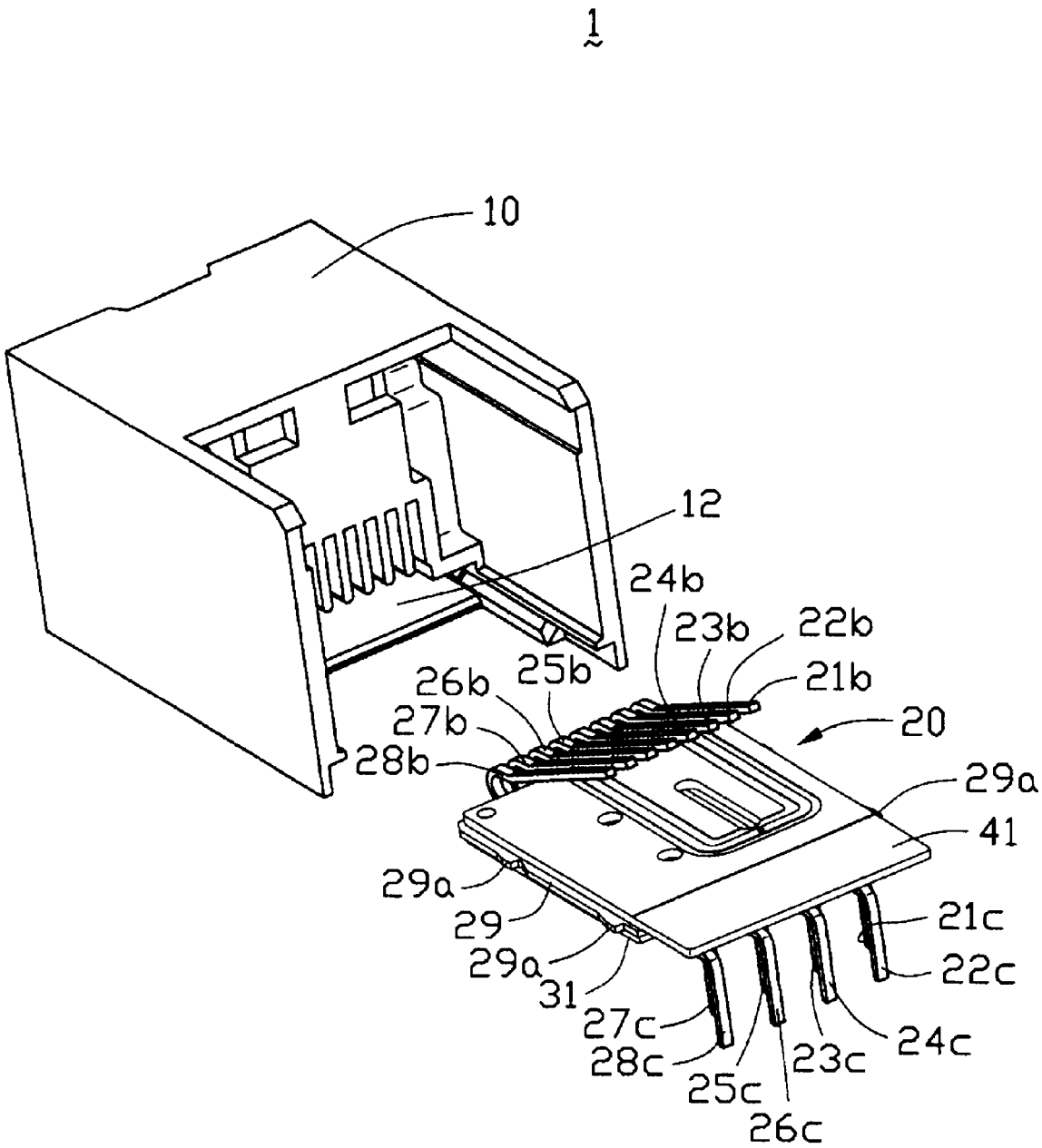
FIG. 1E is an exploded view of FIG. 1C.

Referring to FIGS. 1A to 1E, a RJ modular connector 1 in accordance with the present invention includes a housing 10 defining a plug receiving space 11, and a terminal core receiving space 12 in which a modular terminal core 20 securely attached therein. The RJ modular connector 1 has a general dimension and shape corresponding to existing industry specifications. Accordingly, no details are given thereto. The unique feature of the present invention resides on providing the modular terminal core 20 which can be simply made in a cost-effective manner. In addition, the modular terminal core 20 is arranged such that electrical couplings can be created between selected terminals to balance electrical couplings between selected terminals. By this arrangement, cross-talk between certain terminals can be effectively eliminated or reduced.

Referring to FIGS. 2A to 2D in conjunction with FIGS. 3A to 3F, the terminal core 20 in accordance with the present invention includes a plurality of terminals 21, 22, 23, 24, 25, 26, 27, and 28 and lower and upper or first and second printed circuit boards 31 and 41. The terminals 21, 22, 23, 24, 25, 27 and 28 respectively have contacting portions 21*b*, 22*b*, 23*b*, 24*b*, 25*b*, 26*b*, 27*b*, and 28*b* extending into the plug receiving space 11, leg portions 21*c*, 22*c*, 23*c*, 24*c*, 25*c*, 26*c*, 27*c* and 28*c* extending away from the housing 10, and connecting portions 21*a*, 22*a*, 23*a*, 24*a*, 25*a*, 26*a*, 27*a* and 28*a* connecting the contacting and leg portions 21*b*, 22*b*, 23*b*, 24*b*, 25*b*, 26*b*, 27*b*, and 28*b* and 21*c*, 22*c*, 23*c*, 24*c*, 25*c*, 26*c*, 27*c* and 28*c* and being sandwiched in a common plane between the lower and upper printed circuit boards 31, 41. Among the terminals, terminals 21, 22 configures a first pair, terminals 23, 26 configures a second pair, terminals 24, 25 configures a third pair, while terminals 27, 28 configures a fourth pair. The contacting portions 21*b*, 22*b*, 23*b*, 24*b*, 25*b*, 26*b*, 27*b*, and 28*b* are so formed as to be equally spaced from each other and the leg portions 21*c*, 22*c*, 23*c*, 24*c*, 25*c*, 26*c*, 27*c* and 28*c* are so configured as also to be equally spaced from each other, while the connecting portions 21*a*, 22*a*, 23*a*, 24*a*, 25*a*, 26*a*, 27*a* and 28*a* are differently configured so that the connecting portions 23*a*, 26*a* are located a little far from the adjacent connecting portions 22*a* and 24*a*, 25*a* and 27*a* whereby the terminal pairs 21*a* and 22*a*, 24*a* and 25*a*, and 27*a* and 28*a* are respectively closely arranged with respect to each other, thereby enhancing energy couplings and decreasing cross talk therebetween. In other words, in the present invention, the distance between the two connecting portions 21*a* and 22*a*, or 24*a* and 25*a*, or 27*a* and 28*a*, in the differential pair of the terminals 21 and 22, or 24 and 25, or 27 and 28, is smaller than the distance between the two connecting portions 22*a* and 23*a*, 23*a* and 24*a*, 25*a* and 26*a*, 26*a* and 27*a*.

The lower printed circuit board 31 defines first (top) and second (bottom) surfaces 31*a*, 31*b* and with conductive footprints or conductive pads 321, 322, 323, 324, 325, 326, 327 and 328 formed on the first face 31*a*. A conductive loop 33 is formed on the second face 31*b* and surrounded by a grounding plane 34. The conductive loop 33 is electrically connected to the conductive footprints 323 by means of tunnels 33*a*. Since the tunnel 33*a* is configured by a through-hole coated with conductive material, such as solder, and is known to the skill in the art, no details are given herebelow.

The upper printed circuit board 41 defines first (top) and second (bottom) surfaces 41*a*, 41*b* and with conductive footprints or conductive pads 421, 422, 423, 424, 425, 426, 427 and 428 formed on the second face 41*b*. A conductive loop 43 is formed on the first face 41*a* and surrounded by a grounding plane 44. The conductive loop 43 is electrically connected to the conductive footprints 426 by means of tunnels 43*a* which is identical to the tunnels 33*a*.

Among the footprints 321, 322, 323, 324, 325, 326, 327 and 328, the footprint 323 corresponding to terminal 23 includes first and second portions 323*a*, 323*b*; while footprint 326 with respect to terminal 26 includes also first and second portions 326*a*, 326*b*. Among the footprints 421, 422, 423, 424, 425, 426, 427 and 428, the footprint 426 with respect to the terminal 26 includes first and second portions 426*a*, 426*b*; while footprint 423 with respect to the terminal 23 includes also first and second portions 423*a*, 423*b*.

The connecting portions 21*a*, 22*a*, 23*a*, 24*a*, 25*a*, 26*a*, 27*a*, and 28*a* of the terminals 21, 22, 23, 24, 25, 26, 27, and 28 can be securely sandwiched between the printed circuit boards 31, 41 by applying solder pastes on the footprints 321, 322, 323, 324, 325, 326, 327 and 328 and the footprints 421, 422, 423, 424, 425, 426, 427 and 428, and then reflowing the solder pastes such that the terminals 21, 22, 23, 24, 25, 26, 27, and 28 are completely and securely attached to the footprints 321, 322, 323, 324, 325, 326, 327 and 328 of the lower printed circuit board 31; and footprints 421, 422, 423, 424, 425, 426, 427 and 428 of the upper printed circuit board 41.

Figure 2A:
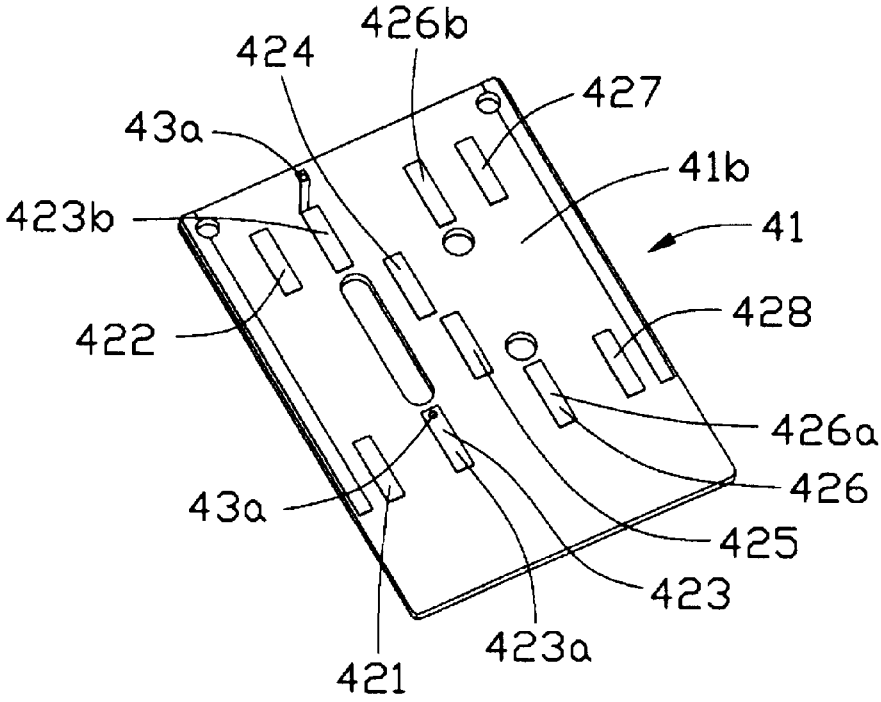
FIG. 2A is a bottom view of a top substrate.
Figure 2B:
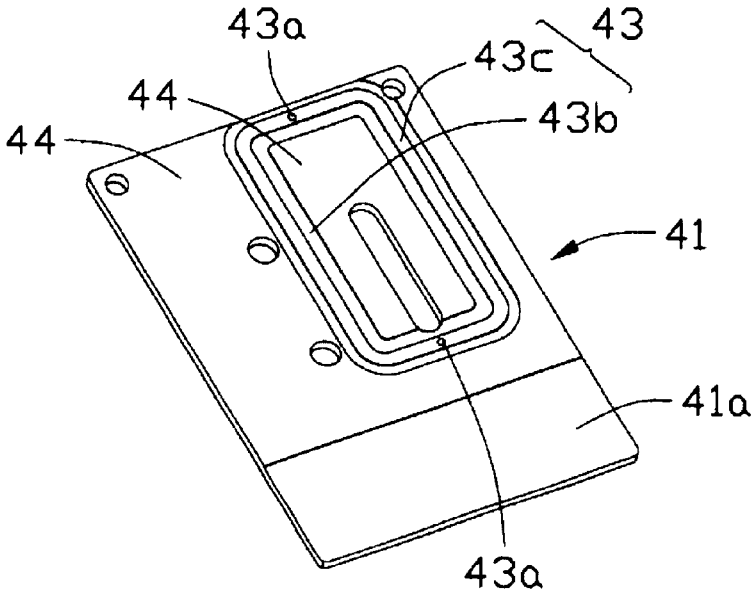
FIG. 2B is a top view of FIG. 2A.
Figure 2C:
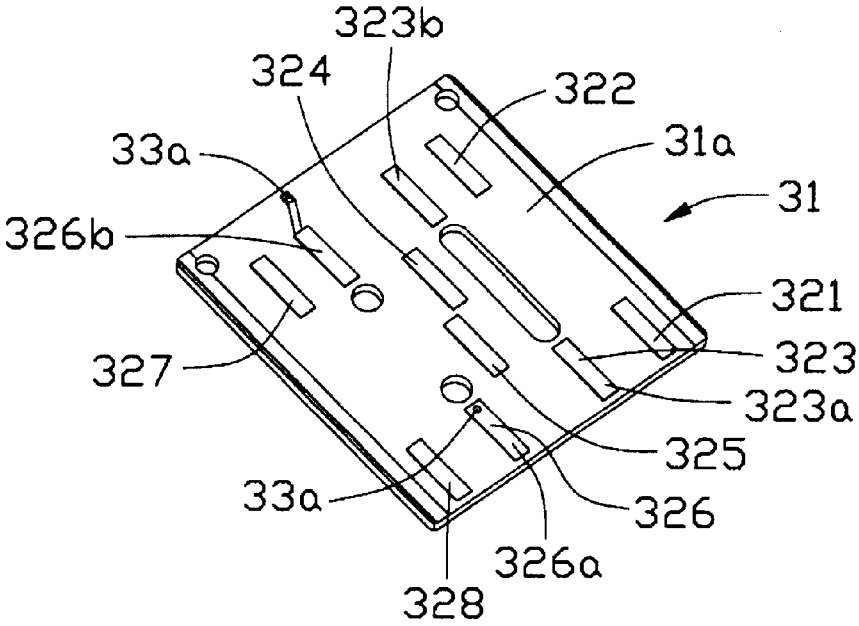
FIG. 2C is a top view of a lower substrate.
Figure 2D:
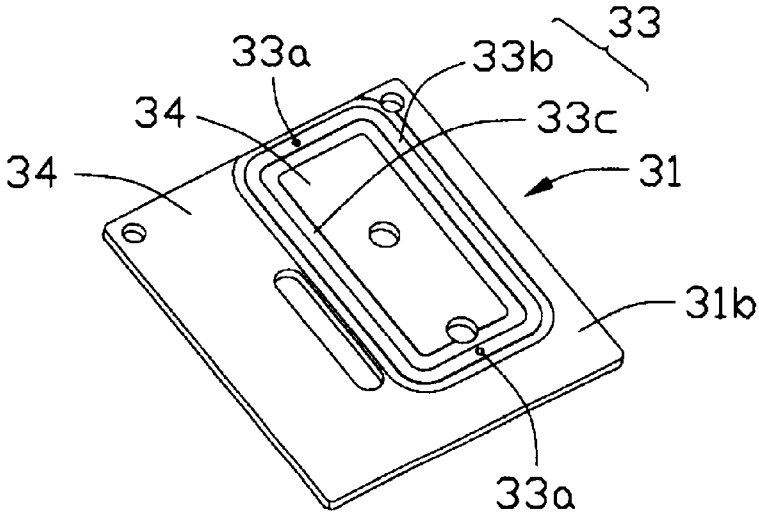
FIG. 2D is a bottom view of FIG. 2C.
Figure 3A:
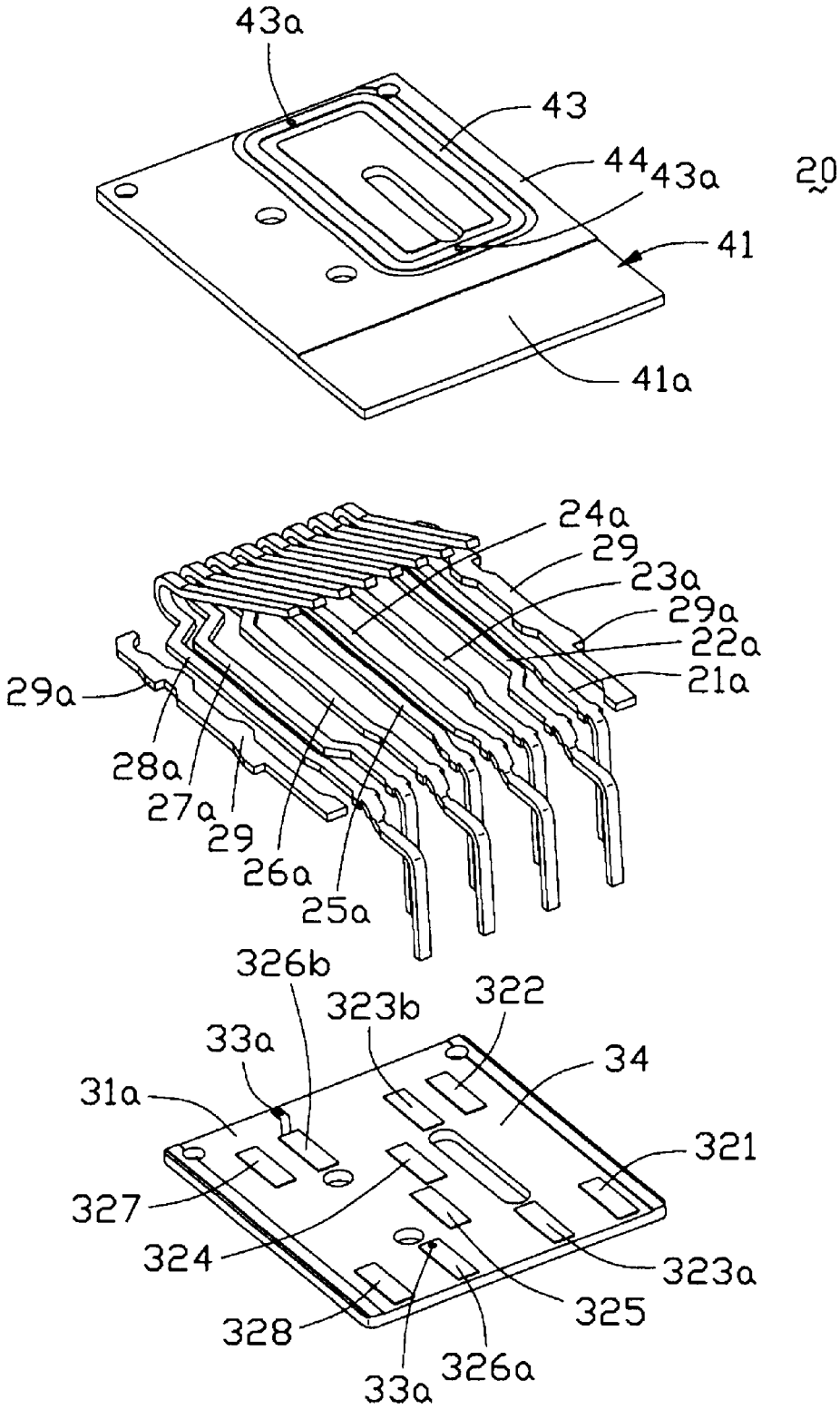
FIG. 3A is an exploded view of a terminal core in accordance with the present invention.
Figure 3B:
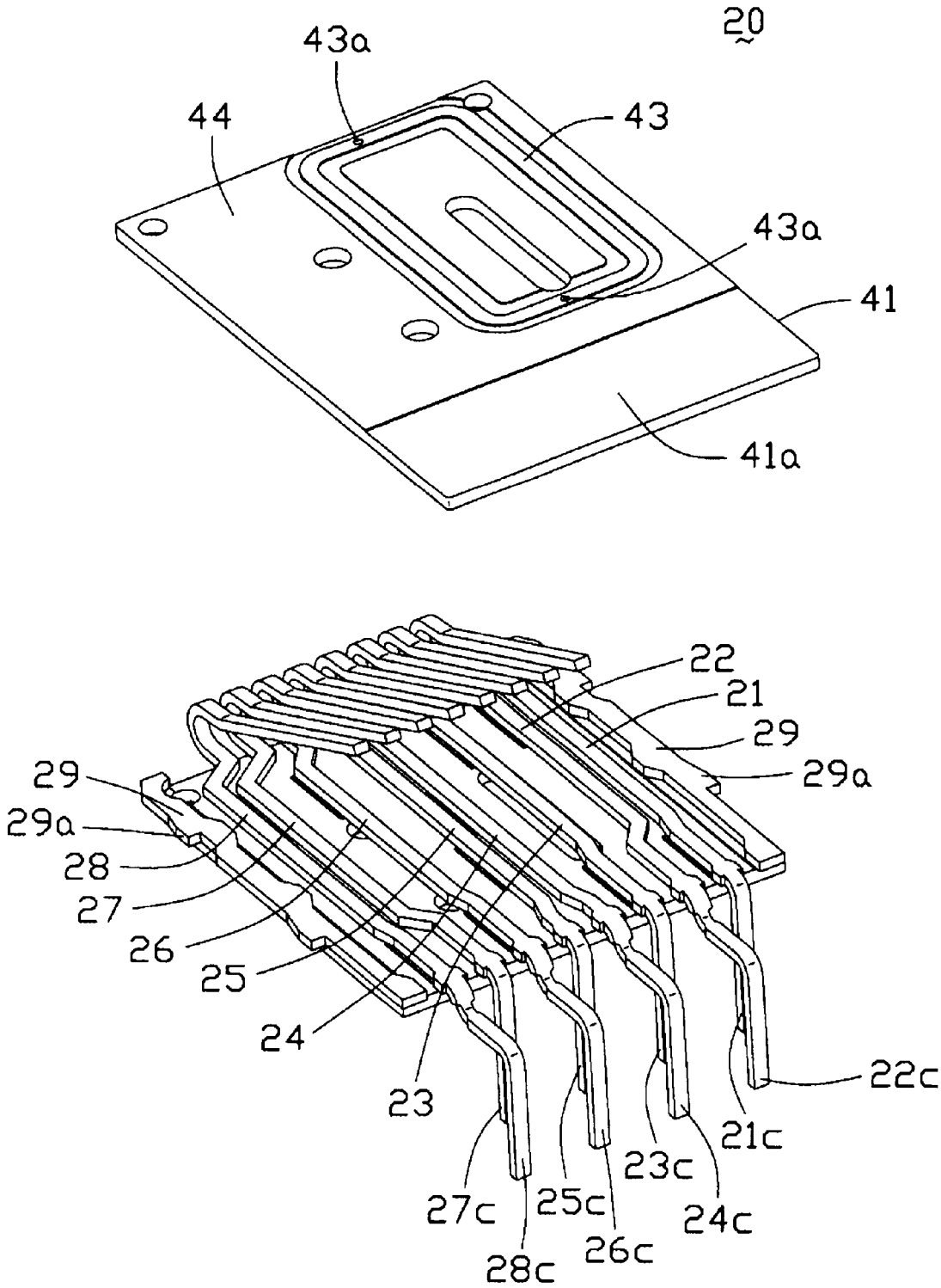
FIG. 3B is similar to FIG. 3A with terminals attached to the lower substrate.
Figure 3C:
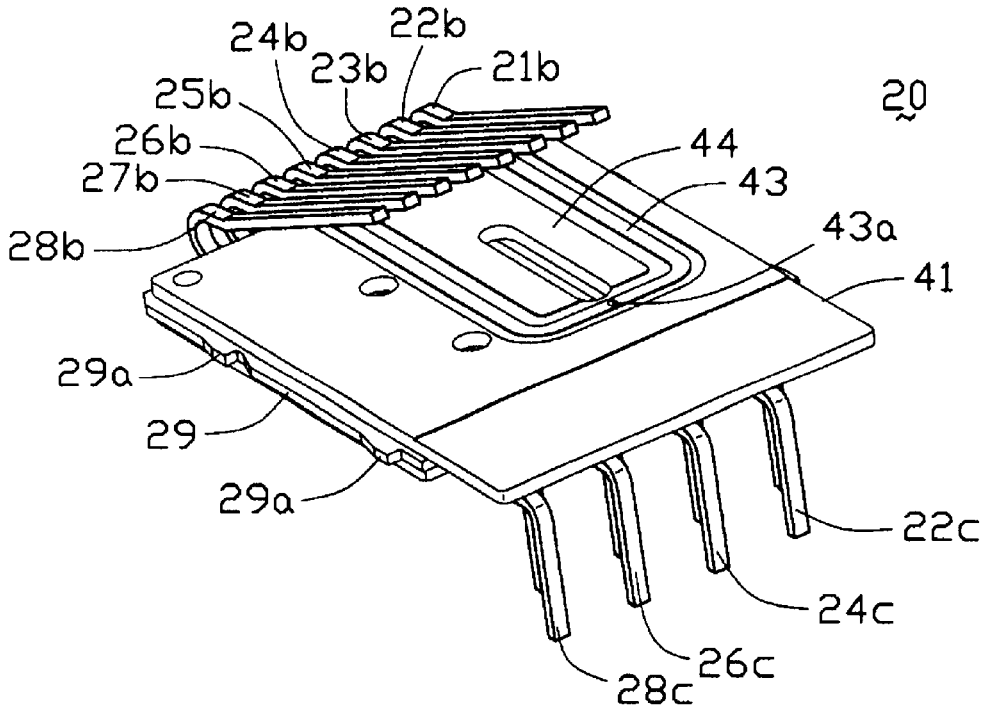
FIG. 3C is an assembled perspective view of the terminal core.
Figure 3D:
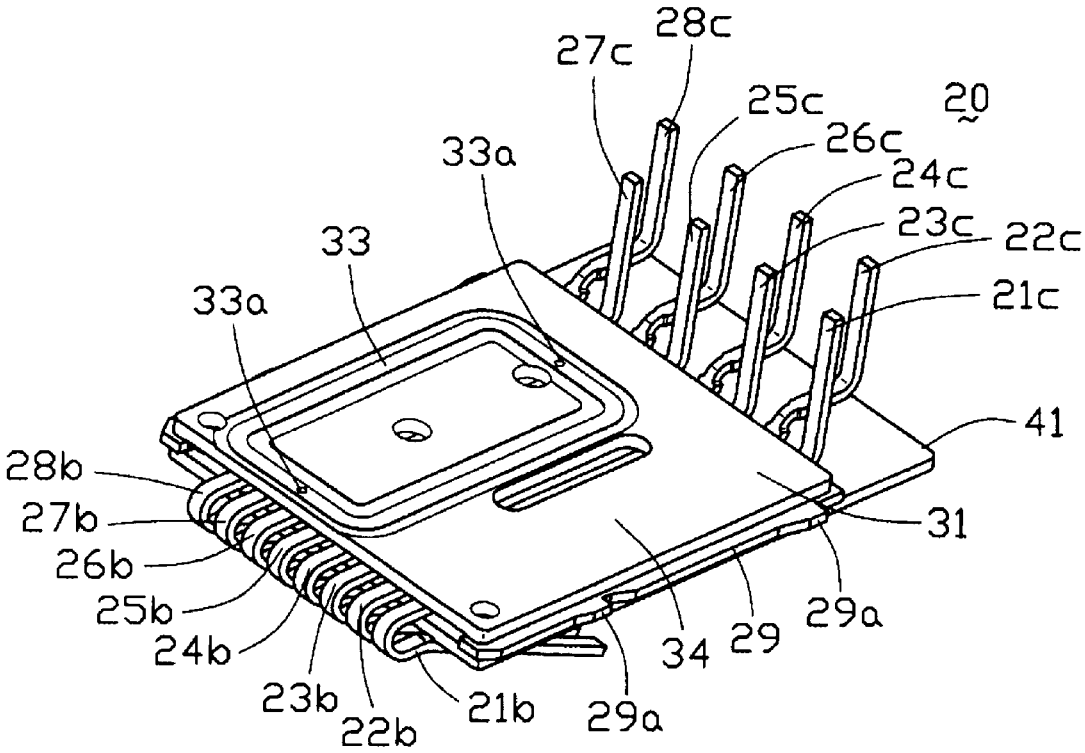
FIG. 3D is another perspective view of the terminal core.
Figure 3E:
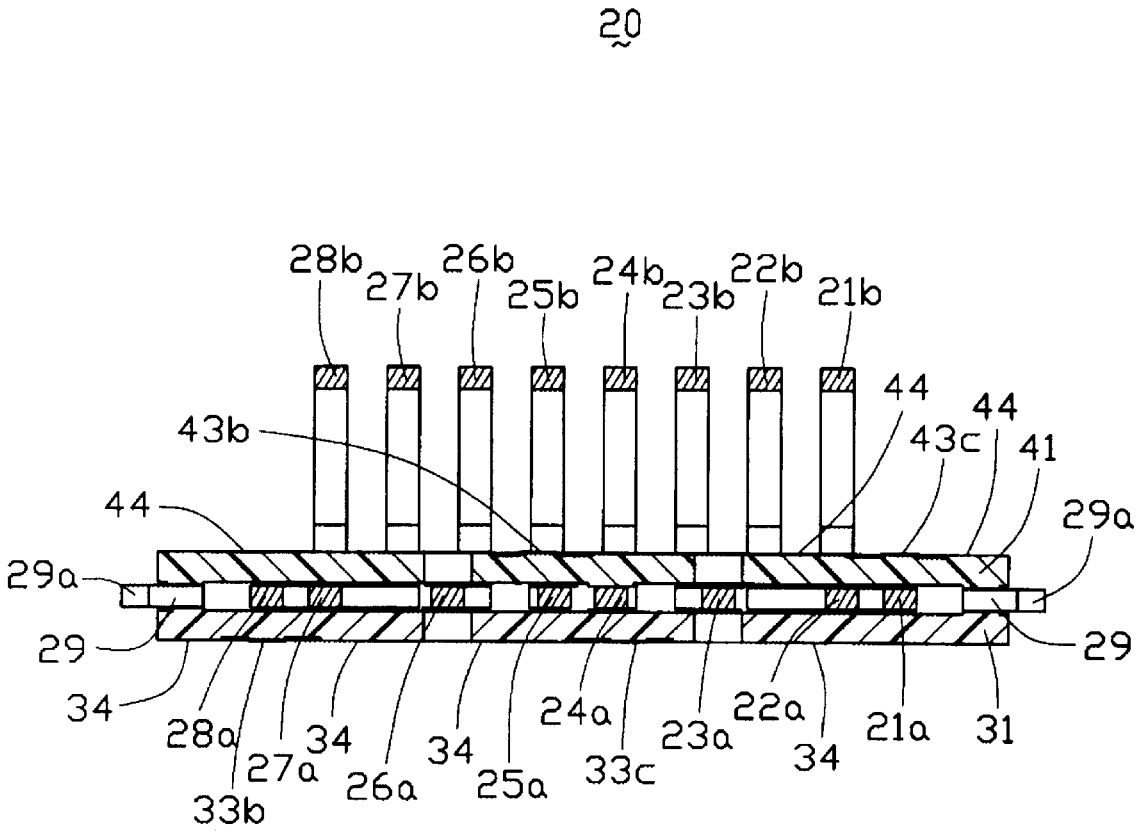
FIG. 3E is a cross sectional view of the terminal core.

As clearly shown in FIGS. 2B, 2D and 3E, the conductive trace 33 formed on the bottom (second) face of the first substrate 31 includes first and second portions 33*b*, 33*c* which are aligned with terminals 28 and 24, while the conductive trace 43 formed on upper (first) face of the second substrate 41 includes first and second portions 43*b*, 43*c* which are aligned with terminals 25 and 21. Accordingly, electrical couplings will be generated between the first portion 33*b* and the terminal 28, and the second portion 33*c* and the terminal 24. By the same reason, electrical couplings will be generated between the first portion 43*b* and the terminal 25, and the second portion 43*c* and the terminal 21. Unwanted electrical couplings between the terminals 23 and 22, 23 and 24, 25 and 26, and 26 and 27 can be better balanced by electrical couplings between the terminals 21 and 23, 23 and 25, 24 and 26, and 26 and 28 established by way of the first and second portions 33*b*, 43*b*, 33*c*, 43*c*.

As can be readily appreciated, the electrical coupling between the third terminal 23 and the first terminal 21 by means of the conductive trace 33 (via first portion 33*b*) will properly help to balance the electrical coupling between the third terminal 23 and the second terminal 22. While, the electrical coupling between the sixth terminal 26 and the eighth terminal 28 by means of the conductive trace 43 (via second portion 43*c*) will also properly help to balance the electrical coupling between the sixth terminal 26 and the seventh terminal 27. As a result, the energy coupled into terminals 23, 26 from terminals 22, 27 can be more properly balanced by the introduction of the electrical couplings between the terminals 23, 26 with respect to the terminals 21 and 28, respectively. As a result, the signal transmitted through the differential pair terminals 23, 26 benefits from balanced coupling from its adjacent terminals, such as terminals 22 and 27. Furthermore, due to the unique arrangement of the connecting portions 21*a*, 22*a*, 23*a*, 24*a*, 25*a*, 26*a*, 27*a*, and 28*a*, the terminals 21 and 22, 24 and 25, 27 and 28 in each differential pair are more closely located than when the eight terminals as usually are equally spaced from one another, thereby enhancing coupling and decreasing cross talk therebetween. As to the differential pair of the terminals 23 and 26, since they are located relatively fartherly from adjacent terminals 22, 24, 25 and 27 and in turn are located fartherly from the second portion 33*c* and the first portion 43*b* of the conductive traces 33 and 43 than those conventional equally spaced terminals, they are minimally affected by adjacent terminals and the conductive traces and the coupling between them are ensured, thereby guaranteeing high speed signal transmission in the two terminals 23, 26.

Figure 3F:
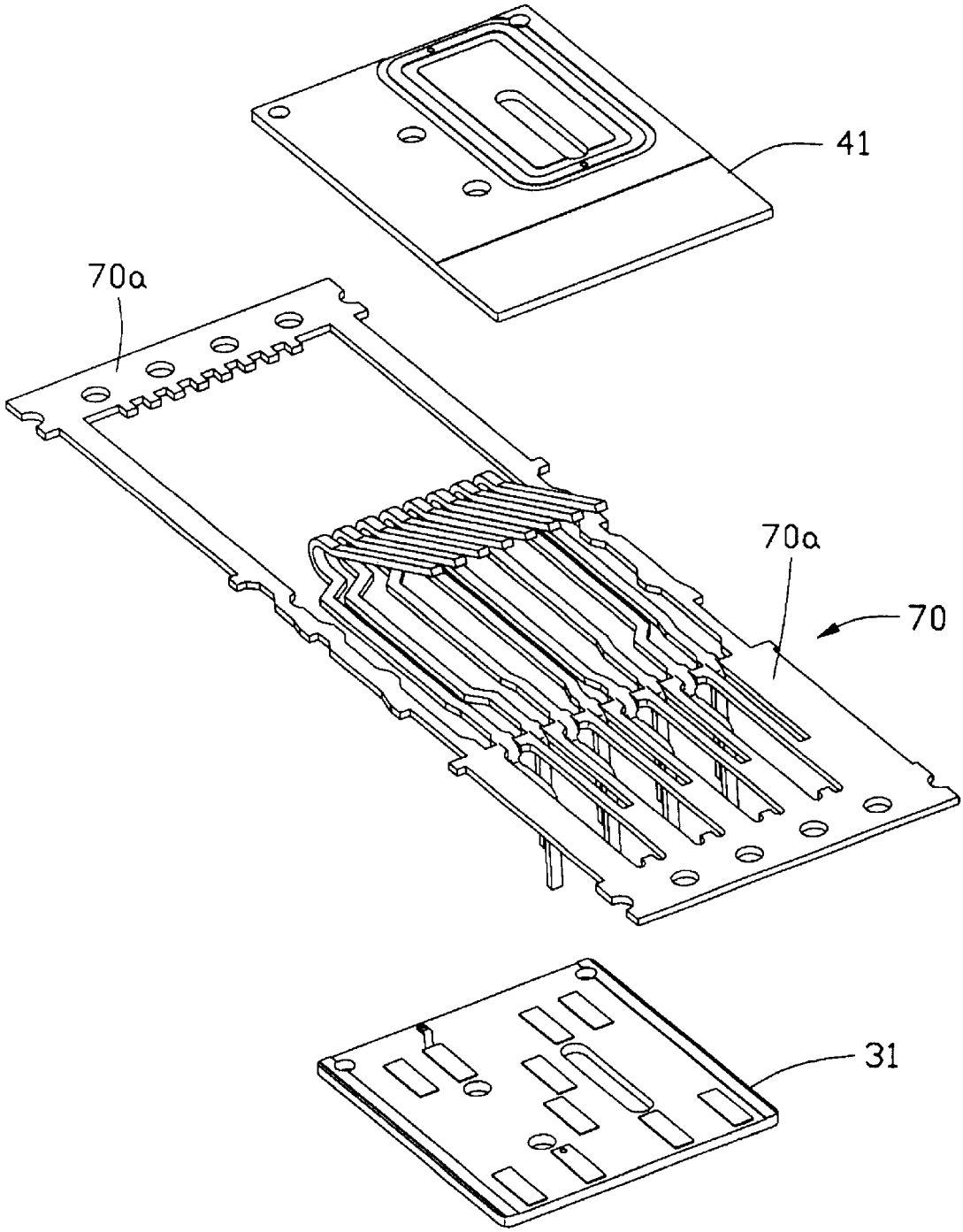
FIG. 3F is an exploded view of the terminal core with carrier attached thereto.

As can be readily seen from FIG. 3F, the manufacturing of the terminal core 20 is comparatively simple as compared to the prior art in which the terminals 21 to 28 are integrally molded or assembled together. In the present invention, the terminals 21 to 28 can be simply stamped from a sheet metal 70. Then the terminals 21 to 28 can be easily sandwiched by the first and second substrate 31, 41. The carrier 70*a* can be simply trimmed off after the terminals 21 to 28 are securely attached and sandwiched between the first and second substrates 31 and 41.

In addition, it can be readily appreciated that during the stamping of the terminals 21 to 28, retaining beam 29 having barbs 29*a* can be also formed on the sheet metal 70 and which are also attached and sandwiched between the first and second substrates 31 and 41 by solder. Accordingly, the terminal core 20 resulted therefrom can be easily inserted into the terminal core receiving space 11 and securely attached therein by the barbs 29*a*.

Furthermore, the distance between the connecting portions 21*a* and 22*a*, between 24*a* and 25*a* or between 27*a* and 28*a* is substantially smaller than the distance between 22*a* and 23*a*, between 23*a* and 24*a*, between 25*a* and 26*a*, or between 26*a* and 27*a*. In this way, electrical couplings within the respective differential pairs of terminals 21 and 22, 24 and 25, and 27 and 28 are increased while couplings and cross-talk between terminals 22 and 23, 23 and 24, 25 and 26, and 26 and 27 are decreased, thereby noises or cross-talks in the terminal core 20 can be effectively reduced.

Even the above embodiment uses patterns of T568A and T568B to illustrate the spirit of the present invention, it can be readily appreciated that coupling issues from other patterns, such as 3-Pair MMJ, USOC 4-pair, and TP-PMD (X3T9.5) and ATM can also be helped out by the teaching of the present invention without creating complex configuration of the terminals. By the teaching of the present invention, the terminals can be made as simple as existing terminals, while the coupling issue can be taken care by the printed circuit board.

Even the present invention illustrates its best mode of embodiments by establishing electrical couplings between conductive loops and corresponding terminals, it can be readily appreciated that the electrical couplings can be also created via conductive loops and conductive pads on which terminals are electrically connected thereto, i.e. terminal heads and tails are connected to the conductive pads extending through a substrate, while the conductive loop and the conductive pads are arranged to create electrical coupling to balance electrical couplings among terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A RJ modular connector, comprising:

a housing defining a plug receiving section, and a terminal core receiving section;

a terminal core received in said terminal core receiving section and including a plurality of terminals;

a first substrate having a first conductive trace thereon, an electrical connection being established between a first terminal of the plurality of terminals and the first conductive trace, a portion of the first conductive trace being arranged to create a first electrical coupling between the first terminal and a second terminal of the plurality of terminals to balance a second electrical coupling between the first terminal and a third terminal of the plurality of terminals arranged between the first and the second terminals; and a second substrate having a second conductive trace thereon, an electrical connection being established between a fourth terminal of the plurality of terminals and the second conductive trace, a portion of the second conductive trace being arranged to create a third electrical coupling between the fourth terminal and a fifth terminal of the plurality of terminals to balance a fourth electrical coupling between the fourth terminal and a sixth terminal of the plurality of terminals arrange between the fourth and the fifth terminals, wherein the terminals each comprise a connecting portion sandwiched between the first and the second substrates, and the connecting portion of the second terminal is located adjacent to and far from the connecting portion of the fourth terminal;

wherein the connecting portion of the first, second, third, fourth, fifth and sixth terminals are arranged in a common plane; and wherein a portion of each conductive trace is parallel to the connecting portions of the first to sixth terminals; and wherein the second terminal electrically couples with and is located close to the third terminal; and wherein the fifth terminal electrically couples with and is located closed to the sixth terminal; and wherein the first terminal electrically couples with the fourth terminal; and wherein the connector further comprising a seventh terminal and a eight terminal electrically coupling with the seventh terminal; and wherein the seventh terminal is arranged between the eighth and the first terminal and is located far from the first terminal but close eight terminal.

* * * * *